US012158330B2

(12) United States Patent
Rowe et al.

(10) Patent No.: US 12,158,330 B2
(45) Date of Patent: Dec. 3, 2024

(54) LIGHTWEIGHT END CAP

(71) Applicant: BAE SYSTEMS plc, London (GB)

(72) Inventors: Nathan William Rowe, Crewe (GB); Joshua Matthew Stubbs, Crewe (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 18/558,948

(22) PCT Filed: Apr. 19, 2022

(86) PCT No.: PCT/GB2022/050969
§ 371 (c)(1),
(2) Date: Nov. 3, 2023

(87) PCT Pub. No.: WO2022/234247
PCT Pub. Date: Nov. 10, 2022

(65) Prior Publication Data

US 2024/0219157 A1 Jul. 4, 2024

(30) Foreign Application Priority Data

May 5, 2021 (EP) ..... 21275055
May 5, 2021 (GB) ..... 2106392

(51) Int. Cl.
*F42B 5/285* (2006.01)
*F42B 5/307* (2006.01)

(52) U.S. Cl.
CPC ..... *F42B 5/285* (2013.01); *F42B 5/307* (2013.01)

(58) Field of Classification Search
CPC ..... F42B 5/285; F42B 5/307; F42B 5/26
USPC ..... 102/467, 469
See application file for complete search history.

(56) References Cited

U.S. PATENT DOCUMENTS

| | | | | |
|---|---|---|---|---|
| 4,147,107 | A | 4/1979 | Ringdal | |
| 5,063,853 | A | 11/1991 | Bilgeri | |
| 11,879,714 | B2 * | 1/2024 | Sprenger | F42B 5/025 |
| 2011/0214583 | A1 * | 9/2011 | Dutch | F42B 5/26 102/464 |
| 2012/0180689 | A1 * | 7/2012 | Schuster | F42B 5/025 102/469 |
| 2015/0075400 | A1 | 3/2015 | Lemke et al. | |

(Continued)

FOREIGN PATENT DOCUMENTS

| | | | |
|---|---|---|---|
| GB | 1568545 | A | 5/1980 |
| GB | 2530908 | A | 4/2016 |
| WO | 2022234247 | A1 | 11/2022 |

OTHER PUBLICATIONS

International Search Report and Written Opinion received for PCT/GB2022/050969. Mailed: Jul. 20, 2022. 11 pages.

(Continued)

*Primary Examiner* — Reginald S Tillman, Jr.
(74) *Attorney, Agent, or Firm* — Finch & Maloney PLLC

(57) ABSTRACT

A lightweight end cap for an ammunition cartridge, said end cap having a central axis along its axial length, with a first radius; wherein said end cap further comprises a swept volume rebate; having a second radius less than the first radius, wherein the second radius is at least 10% smaller than the first radius, and wherein the swept volume rebate extends along at least 10% of the axial length of said end cap, wherein the end cap further comprises an extractor groove suitable for receiving an ejection mechanism.

20 Claims, 7 Drawing Sheets

(56) References Cited

U.S. PATENT DOCUMENTS

| | | | |
|---|---|---|---|
| 2018/0066925 | A1 | 3/2018 | Skowron et al. |
| 2019/0137244 | A1 | 5/2019 | Burrow et al. |
| 2019/0310059 | A1 | 10/2019 | Burrow |
| 2020/0011646 | A1 | 1/2020 | Burrow et al. |
| 2020/0158483 | A1 | 5/2020 | Burrow |

OTHER PUBLICATIONS

Search Report under Section 17(5) received for GB Application No. 2106392.0 dated Oct. 28, 2021. 4 pages.
Extended EP Search Report received for EP Application No. 21275055.8, dated Oct. 22, 2021. 4 pages.

* cited by examiner

LIGHTWEIGHT END CAP

FIELD

The present invention relates to a lightweight end cap for an ammunition cartridge and a related method of manufacture.

BACKGROUND

The manufacture of rounds for use in small arms follows a standardised process and involves the separate construction of a projectile and a case the latter comprising a primer and a propellant to propel the projectile. Both the case and projectile are typically formed from a ductile material that is capable of being reshaped through a series of dies. The projectile and case components are joined as part of the final stages of the process to form the round, which then undergoes a quality check.

The formation of brass cartridge cases is well known in the art, the cartridge cases are initially formed from a metal cup, these are commonplace components used in the drawing process for high velocity rounds, those typically used in rifled barrels. The metal cup is typically passed through a series of dies to form a longer, thinner metal cylinder. The base of the metal case tube is known as an end cap and is shaped to receive a percussion cap (primer cap) and an ejector groove. The end cap portion comprises a wall thickness substantially thicker than that of the chamber portion holding the propellant and as such, makes up a substantial source of mass of the ammunition cartridge as a whole.

To reduce the burden on the user, there is a drive to reduce the mass of ammunition cartridges. Accordingly, a lightweight end cap is provided in the following disclosure.

DETAILED DESCRIPTION

According to a first aspect, there is provided a lightweight unitary end cap for an ammunition cartridge, said end cap having a central axis along its axial length, with a first radius; wherein said end cap further comprises a swept volume rebate; having a second radius less than the first radius, wherein the second radius is at least 30 to 60% smaller than the first radius, and wherein the swept volume rebate extends along in the range of 30-95% of the axial length of said end cap, wherein the end cap further comprises an extractor groove suitable for receiving an ejection mechanism.

The largest outer periphery of the end cap defines the first radius, that is to say, the end cap's widest portion. The first radius may be defined by a rim located at the rearmost end of the end cap, this end defined as the end furthest from the projectile i.e. at the rear of the ammunition cartridge relative to the direction of travel. The lightweight end cap may be suitable for use with any calibre of ammunition cartridge.

The unitary end cap is formed from a single piece of material, to provide rigidity and strength.

The lightweight end cap may be suitable for NATO standard ammunition cartridges. The cartridge radius and its dimensions such as for use with 5.56, 7.62, 9 & 12.9 mm rounds, are very well defined.

The second radius is smaller than the first radius, and is provided on the end cap to create the swept volume rebate, i.e. there is the annular removal of material to create a groove or alternatively an open ended rebate extending around the end cap. In one arrangement, the second radius may return to a first radius such that the swept volume rebate may resemble a '⊂' shaped groove. In an alternative arrangement, the first radius may transition or taper to a second radius only and therefore may resemble an 'L' shaped profile, of an open ended rebate.

Preferably, the swept volume rebate is a '⊂' shaped profile. Whilst the figures '⊂' and 'L' have been used to describe the relative differences between the first and second radii, these profiles are non-limiting and the exact profile of the end cap and associated transitions between radii may take a variety of forms, for example a smooth taper between the first and second radii or a sharp transition in the form of a 90° cornered channel or a complex profile comprising multiple transitions. There may be provided a third radius, fourth radius etc. along the axial length of the end cap to create a complex profile whilst not departing from the teaching of the invention.

The second radius may be in the range of at least 10% to 60% smaller than the first radius. The second radius may be at least 20% smaller, at least 30% smaller than the first radius. The second radius may be in the range of from 30-60% smaller than the first radius. Preferably, the second radius may be at least 30% smaller than the first radius.

The swept volume rebate may extend along at least 20% to 95% of the axial length of the end cap, the axial length being defined as coaxial to the central longitudinal axis of the end cap when joined to the cartridge. The swept volume rebate may extend along at a length in the range of from 30 to 95% of the axial length of end cap. Preferably the swept volume rebate may extend along at a length in the range of from 60% to 70% of the axial length of the end cap. More preferably, the swept volume rebate may extend along a length of 65% of the axial length of the end cap.

In a preferred arrangement the second radius may be 45% smaller than the first radius and the swept volume rebate may extend 65% along the axial length of the end cap.

The removal of material results in a significant mass reduction of at least 33% compared to known end cap designs, without compromising the structural integrity of the end cap in use. For example, a stainless steel end cap of the present disclosure using a steel with density 8.0 g/cm$^3$, a first radius of 9.5 mm, a second radius of 5.16 mm and an axial length of 4.85 mm may weigh 1.3 g compared to known 7.62 mm calibre end caps which may weigh 3.8 g; a weight reduction of nearly 65%. The swept volume is both deeper and longer than conventional rebates found on known end caps whilst retaining the end cap's integrity and suitability for use with known weapon systems. In another example, a stainless steel end cap of the present disclosure using a steel with density of 8.0 g/cm$^3$, a first radius of 9.5 mm, a second comparably smaller radius of 4.9 mm, an axial length of 4.85 mm may weigh 1.08 g; a 72% weight saving.

The reduced mass of the end cap provides a lightweight ammunition cartridge which results in a significant percentage reduction in mass. This may only be a few grams when comparing individual rounds, however taken together as a whole, for example, a link of ammunition, a magazine box or a pallet of ammunition, yields substantial weight savings. Such weight savings may allow an operator to carry more rounds on their person during operations or may allow a transport system to move more rounds e.g. a helicopter may be able to lift more rounds on a pallet due to the weight saving or may be able to lift the same given weight of rounds in more extreme conditions, e.g. hot and high climates.

The end cap may comprise two substantially flat faces, a charge side and a percussion side (typically the rim of the end cap). The unitary end cap comprising the charge side and the rim formed from a single piece of material.

When the end cap is fitted to an ammunition casing, the percussion side faces away from the adjoining cartridge case whereas the charge side faces into the adjoining cartridge case. The end cap comprises a chamber or cavity which, in use, houses a percussion cap (sometimes referred to as a "primer"). The end cap further comprises a through-hole, referred to as a flash tube extending from the percussion side to the charge side, through which the primer cap's energetic output travels to initiate a gun propellant located in the adjoining cartridge case.

It will be appreciated that wherein the end cap comprises a cavity or chamber for receiving a primer cap, the minimum dimension of the second radius of the end cap may be limited by the maximum internal radius of the cavity leaving a sufficient thickness of material to prevent the rear most rim of the end cap shearing when engaging with the ejection mechanism. Such thickness is known by the skilled person with consideration for the material properties of which the end cap is formed. For example, 7.62 mm ammunition should ensure that thickness between the maximum internal radius of the cavity and the second radius of the end cap be no less than 0.5 mm.

The end cap comprises an extractor groove to receive an ejection mechanism. The extractor groove function is to receive part of the ejection mechanism which 'hooks' into the groove and pulls against the rearmost rim of the end cap to eject the fired round from the chamber of the weapon system. The extractor groove may be a separate groove to that of the swept volume rebate. In a one arrangement, the swept volume rebate may be configured to act as the extractor groove i.e. the profile of the swept volume rebate may be configured such that the ejection mechanism may adequately hook into the swept volume rebate and eject the cartridge without the need for a separate extractor groove.

It has been found that with exceptionally high rates of firing that the ejector groove may be further refined to that of a conventional ejector groove profile. In a highly preferred arrangement, the end cap is made from a first material and the swept volume rebate is filled with an insert made from a second material, the second material having a density lower than the first material. The insert may be an annular component comprising an inner radius which may be inserted into the swept volume rebate such that the rebate is effectively filled with a lighter mass second material than that of the first material of the end cap.

The geometry of the insert may be selected to allow a close snug fit within the swept volume, for example the inner radius of the insert may be substantially the same as the second radius of the end cap to prevent the insert moving within the groove. Similarly, the axial length of the insert may be substantially the same as the axial length of the swept volume rebate. The insert may be dimensioned to form an interference fit with the end cap i.e. the inner radius and the axial length may be slightly smaller and larger respectively compared to the second radius and axial length. Alternatively, the insert may only occupy a partial volume of the swept volume rebate. It will be appreciated that the outer radius of the insert may not extend to a radius greater than the first radius of the end cap in order to prevent fouling in a chamber of a weapon system.

The geometry of the insert may provide the ejection groove either in combination with the swept volume rebate or alone. Provision of an insert as part of the ejection groove is particularly useful for weapon systems with high rates of fire e.g. machine guns. In one arrangement, the insert comprises a geometry such that when fitted to the end cap within the swept volume rebate, the end cap profile resembles an exact replica of the profile of a traditional end cap thereby ensuring compatibility with existing weapon systems. In one arrangement, the extractor groove is formed from a combination of the insert and the end cap. For example, the extractor groove may resemble a '<' shaped notch wherein one part of the '<' is provided by the rim portion of the end cap, and the other part is provided by the profile of the insert. Alternatively, the extractor groove may be formed solely from the insert. That is to say, the insert comprises a geometry in the form of an extractor groove, which the ejection mechanism solely interacts with.

The provision of an insert with a lower density material than the first material of the end cap, will provide a substantially lower mass than conventional designs of end cap.

The insert of the end cap may be formed from a low density metal, metal alloy, metalloid, polymer or polymer composite. The material of the insert will be chosen according to the needs of the end cap and expected operating parameters of the ammunition cartridge, in general, the insert must not be brittle or hygroscopic. Preferably the insert is formed from a polymer.

The end cap may be formed from a metal, metal alloy, metalloid, composite or ceramic. Preferably, the end cap is formed from titanium or stainless steel.

The end cap may be formed from a metal matrix composite, an admixture of metal powder and a binder matrix. In this case, the powder may be selected from any metal powder or alloy thereof.

The end cap may be formed from a cellular structure, such as lattice or honeycombed type structure, such as wherein at least 30%-80% of the internal volume of the end cap is a cavity or void structure.

The end cap may be formed from an admixture of metal powder and binder matrix in combination with the swept volume rebate arrangement may yield an extremely light weight end cap.

According to a second aspect, there is provided an ammunition cartridge comprising a cartridge case and the light weight end cap as herein defined.

The ammunition cartridge comprises a cartridge case and an end cap as defined herein. The cartridge case holds the propellant. The cartridge case may comprise a first end which is closed by the end cap as defined herein. The cartridge case may be substantially cylindrical and comprise an internal diameter at the first end suitable for receiving the end cap. The cartridge case may further comprises a second end, which is open and configured to receive a projectile opposite to the first end.

The material of the cartridge case may be selected from a group comprising polymers, metals, metal alloys or metalloids. Preferably a metal, such as for example stainless steel or titanium.

The cartridge casing case may be joined to the end cap by any mechanical, chemical or physical fastenings. In particular, the end cap may be arranged to join with the ammunition cartridge casing case by way of a weld join or a rivet join. The chemical fastening may be an adhesive bond or sealant.

In one arrangement, the cartridge case material is a polymer, the material may be selected from thermoset, thermoplastics, such polymers may be block polymers, co-polymers, elastomers, fluoroelastomers and combinations thereof.

The polymeric case may be a fibre reinforced polymer composite case.

The fibres may be fibre ply, fibres, chopped fibre, fibre threaded windings. The fibres may be any commonly used fibre such as, for example, glass, carbon, polymers, such as, for example polyarimid, metals.

The polymeric case may comprise particulate fillers, such as, for example, filaments, leaf or other particles.

The particulate fillers may be any material, such as, for example metals, metalloids, ceramics, metal alloys thereof. The particulate fillers may be nano particulate, or multi-modal loaded polymer composites. The nano particulate may be carbon, such as for example carbon nanotubes, graphene, graphitic fillers.

The fibres and/or particulate fillers may be present in the range of 5 to 80%, and the remainder the respective curable monomer to form the selected polymer case.

Wherein the cartridge case is a polymer, the cartridge case may further comprise an outer skirt; wherein the outer skirt is arranged to engage over the first radius of the end cap, the outer skirt further comprising a retaining portion; wherein the retaining portion engages with the swept volume rebate of the end cap to form an insert. The inner radius of the retaining portion may comprise a taper or transition to a radius less than the first radius of the end cap, preferably substantially equal to the second radius of the end cap in order to neatly form a snug fit into the swept volume rebate. In this arrangement, the cartridge case may effectively be joined to the end cap by way of the outer skirt wherein the retaining portion acts as a male portion to engage with the swept volume rebate acting as a female portion. Put another way, the skirt and retaining portion of the cartridge case may effectively act as an insert as herein described in the first aspect.

In this arrangement, the ejector groove may be formed solely by the polymer cartridge case or may be formed by a combination of the cartridge case, specifically the retaining portion and end cap as defined in the first aspect.

The use of a polymeric cartridge case in conjunction with the light weight end cap may yield an extremely light ammunition cartridge compared to known designs.

Preferably the end cap may be made from steel with a polymer insert, and riveted to a stainless steel cartridge case.

According to a further aspect, there is provided a method of manufacture of the lightweight end cap wherein the method comprises the steps of: forming the end cap from a first material;

removing material from the end cap to create a swept volume rebate on the end cap;

providing an ejection profile suitable for receiving an ejection mechanism on the end cap.

The end cap may be a metal, metal alloy or metalloid, the end cap may be formed from any known process, for example, machining from a billet. The step of material removal may be carried out using a lathe, CNC machine, or any other known technique to gouge material to form the swept volume rebate.

Alternatively, the step of forming the end cap may be carried out by an additive layer manufacturing technique, for example selective laser sintering. It may be appreciated in this instance that the step of removing material to form the swept volume rebate on the end cap may not be necessary as the end cap is formed in a near final shape.

The end cap may be made from an admixture of a metal powder and binder matrix, the admixture may be fabricated by any known techniques for example, solid state methods, liquid state methods, additive layer (3D printing). Solid state methods may be power blending and consolidation (sintering such as hot isostatic pressing), diffusion bonding, physical vapour deposition. Liquid processing may stir or squeeze casting, infiltration spray deposition. The processing may also be in-situ processing such as chemical curing. The end cap may be formed in a near final shape without the need to remove material in a separate step to form the swept volume rebate.

The method may further comprise the additional step of filling the swept volume rebate with the insert made from the second material. The insert may be manufactured by injection moulding in situ onto the end cap. Alternatively, the insert may be 'poured' in a molten state into a swept volume rebate of the end cap before being machined or swaged into a final form. Alternatively, the insert may be manufactured in situ onto the end cap by additive layer techniques. Alternatively the insert may be split into 2 or more segments which are located around the groove and bonded together to form the insert.

The method may further comprise the additional step of joining the end cap to a cartridge case by way of welding. In the context of the present disclosure, "welding" is intended to cover joining processes that produce bonding of materials by heating, which may be done with or without pressure or filler material. For example, the term is intended to encompass brazing and soldering. It may also be taken to encompass a process in which the material of one or more articles being joined are brought into a molten state to facilitate bonding. It may include a process in which the base materials melt along with a filler material.

The weld may be provided around the circumference of the cartridge case and the end cap in a region where they interface with one another. The join may be a through weld or stake weld.

Alternatively the cartridge case and the end cap may comprise an adhesive to bond and thereby join them together in the interior of the cartridge case, for example in a region around a circumferential edge of an interface between the cartridge case and the end cap.

The weld may achieved by laser welding. Alternative weld joins may be provided which brought only material of the cartridge case into a molten state, or brought material of both the cartridge case and end cap into a molten state.

The method may further comprise the additional step of joining the end cap to cartridge case by way of rivet joining. For example, a deformable member may be provided as a rivet like element which is provided separately to end cap and cartridge. The deformable member may be cylindrical, hollow and thin walled. The deformable member may extend along a passage in the end cap and through an orifice in the cartridge case. The deformable member may be provided with at least one deformable end, or lip, which is deformable between a first shape (for example an undeformed configuration or state) in which the deformable member may extend between the cartridge case and the end cap during assembly, and a second shape (for example a deformed configuration or state) which fixes the cartridge case and the end cap together. For example, the deformable end of the deformable member may be swaged to bring the end cap and cartridge case into a fixed relationship relative to one another.

BRIEF DESCRIPTION OF THE FIGURES

Embodiments of the invention will now be described by way of example only with reference to the figures, in which:

FIG. 1 shows prior art, a conventional end cap 100 for use with an ammunition cartridge. The end cap comprising a first radius 102 and a second radius 104 wherein the second radius 104 defines an ejector groove 106. The end cap further comprises a cavity 108 located on the rearmost face of the end cap 100 wherein a primer 110 is located. The end cap 100 further comprises a through hole or flash passage 112 linking the primer 110 to an adjoining ammunition cartridge casing 114. In this example, the end cap 100 is formed from brass drawn through a series of dies to create a near final shape before being joined to the cartridge casing 114. It may be appreciated however that brass has demerit in that it is also relatively dense, and hence the end cap 100 forms a relatively large percentage of the mass of the whole cartridge. In this example, it may clearly be seen that the second radius is only 5% smaller than the first radius. The ejector groove extends, in the form of a taper for only 20% of the total axial length of the end cap 100. Therefore only a very minor volume of the end cap material is absent.

FIG. 2 (not to scale) shows an example of an arrangement of the light weight end cap 200 of the present disclosure. In this example, the end cap 200 is a substantially cylindrical component comprising a first radius 202; wherein said end cap 200 further comprises a recess having a second radius 204, the second radius 204 less than the first radius 202 defining a swept volume rebate 206, wherein the second radius 204 is at least 45% smaller than the first radius 202, and wherein the swept volume rebate 206 extends along 65% of the axial length of end cap 200 indicated by length X, wherein the end cap 200 further comprises an extractor groove 208 suitable for receiving an ejection mechanism.

Figure 1:
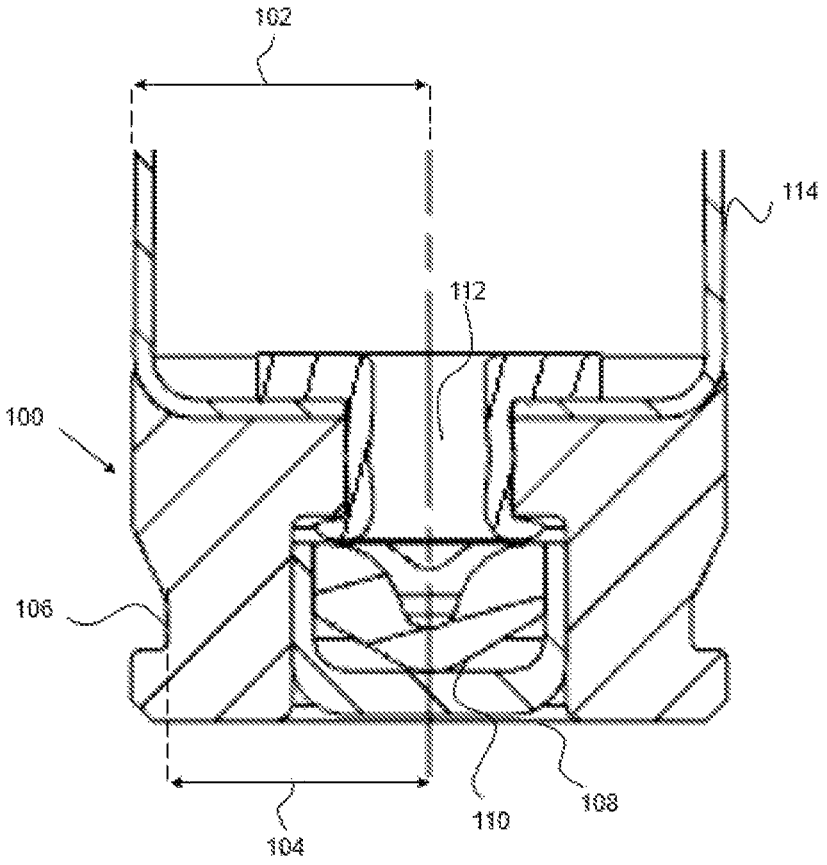
PRIOR ART Fig.1
FIG. 1 shows an example end cap of the prior art.

In this arrangement, the extractor groove is provided solely by the swept volume rebate 206. In operation, the hook of the ejection mechanism contacts with the rearmost rim 231 of the end cap indicated by arrow A. The end cap 200 further comprises a chamber or cavity 210 located on the rearmost face of the end cap 200 for receiving a primer (not shown). The end cap further comprising a through hole 212 known as a flash tube extending from the percussion side 232 to the charge side 233 thereby linking the cavity 210 to the chamber of an ammunition cartridge casing (not shown).

In this arrangement, the swept volume forms a 'C' shape annular groove or recess on the end cap 200 as the radius transitions from a first radius 202 to a smaller second radius 204 before returning to a first radius 202. Preferably the rim 231 is formed from the first material of the end cap to withstand the forces of the ejection mechanism on the round from a weapon system. It can be seen therefore that in comparison to the end cap of FIG. 1, the swept volume rebate 206 is both deeper and longer than the ejector groove 106 of the prior art leading to a substantial reduction in the mass of the end cap 200.

In this example, the end cap 200 is formed from stainless steel machined or drawn from a billet.

Figure 2:
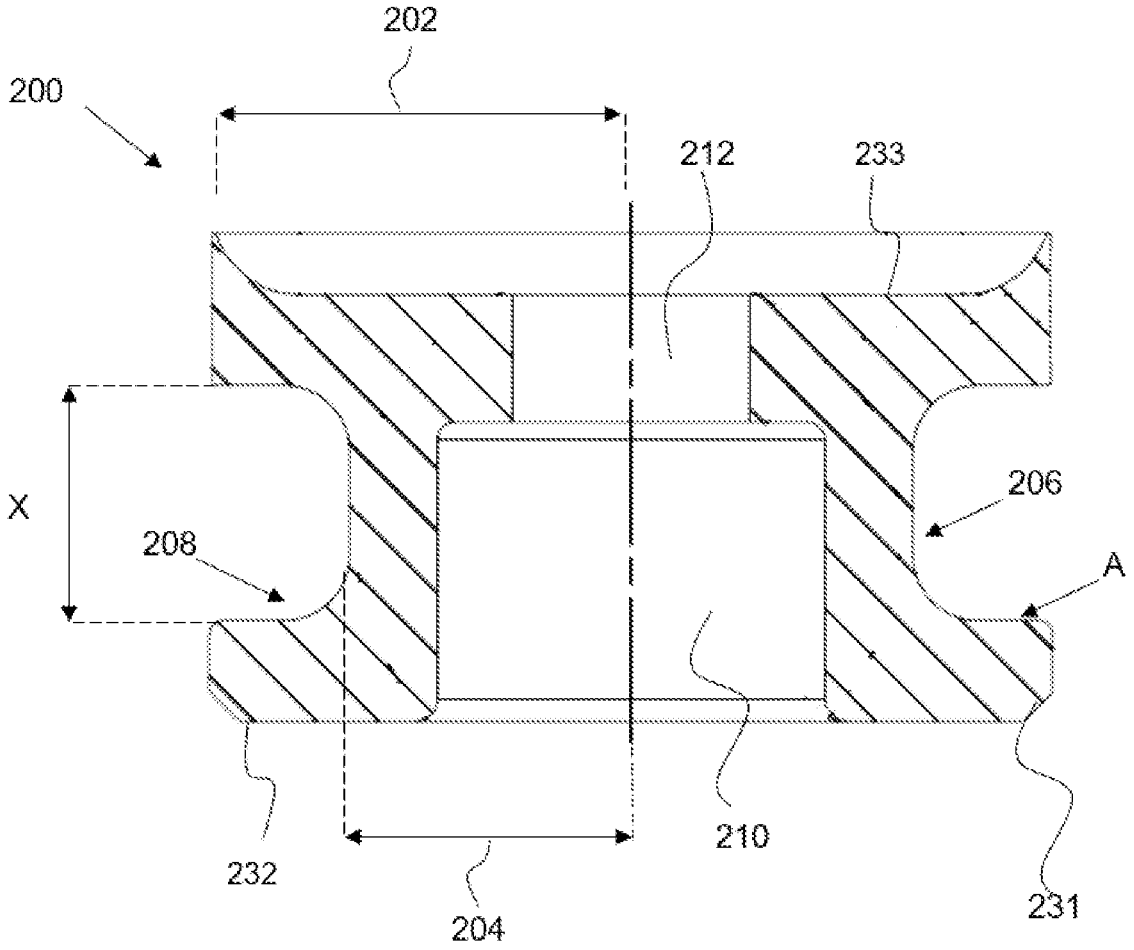
FIG. 2 shows an arrangement of the light weight end cap.
Figure 3:
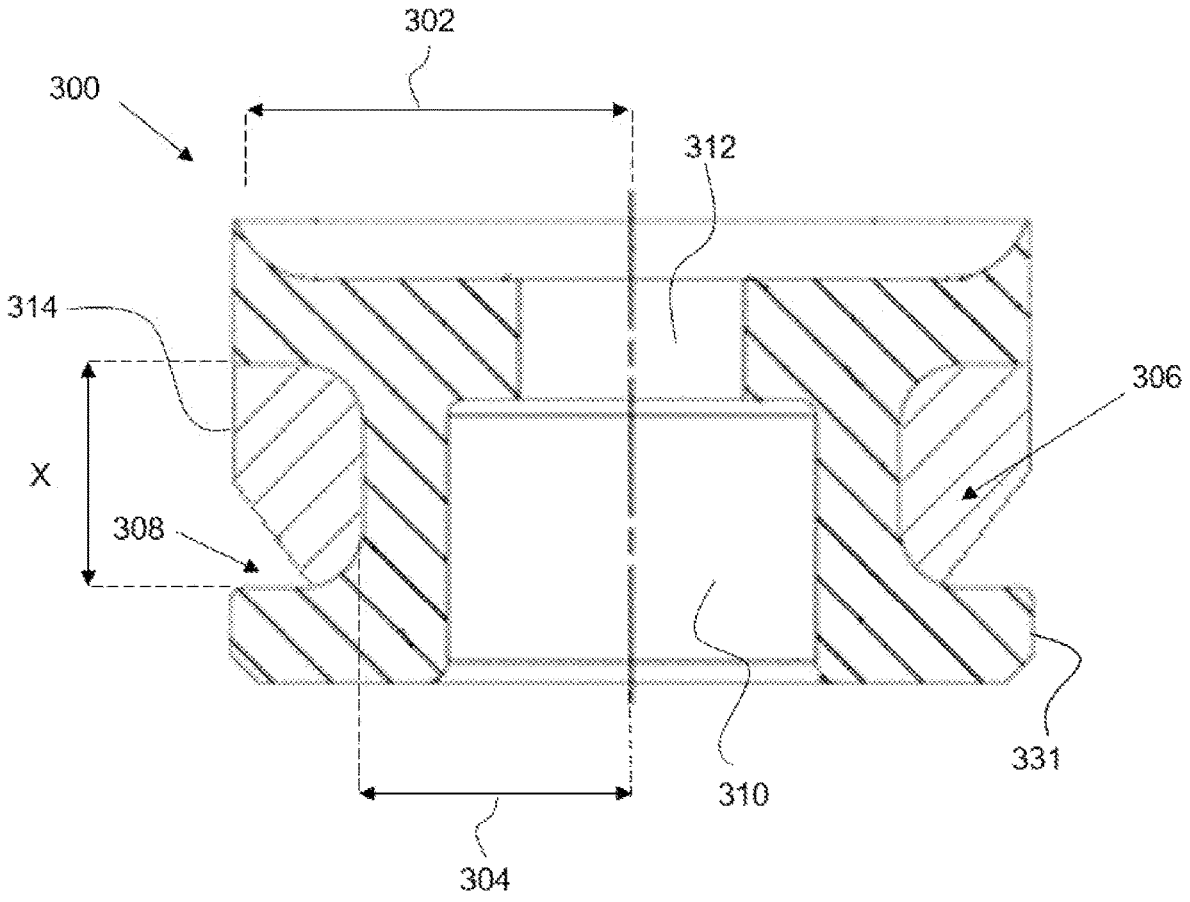
FIG. 3 shows an alternative arrangement of the light weight end cap.

Turning to FIG. 3, there is provided the end cap 300 of FIG. 2 provided with an insert 314. Said insert 314 is an annular component comprising an inner radius substantially equal to the second radius 304 of the end cap 300 and an axial length substantially equal to that of the axial length of the swept volume 306 of the end cap 300. The insert 314 is therefore securely retained within the swept volume radius 306. In this example, the end cap 300 is made from a first material (steel) and the insert 314 is made from a second, lower density material, in the form of a polymer. In comparison with the end cap 200 of FIG. 2, the mass of end cap 300 is greater due to the provision of the insert 314 however mass of the end cap 300 and insert 314 still comprise a significantly reduced mass compared to the end cap 100 of the prior art as shown in FIG. 1.

In this arrangement, the ejector groove 308 is provided by a combination of both the insert 314 and the swept volume rebate 306. As can be seen from the figure, the ejector groove 308 is provided in the form of a '<' shaped notch or groove wherein one part of the '<' is provided by a chamfer on the insert 314 and the other part is provided by the rim 331 formed by the swept volume rebate 306. The provision of insert 314 may be suitable with high rate of fire weapon systems, e.g. machine guns as the insert 314 acts as a guide to allow the hook of an ejection mechanism (not shown) to slide along the outer circumferential face of the insert 314 and into the '<' notch, gripping against the rearmost rim 331 of the end cap 300 allowing the round to be ejected from a chamber.

Figure 4:
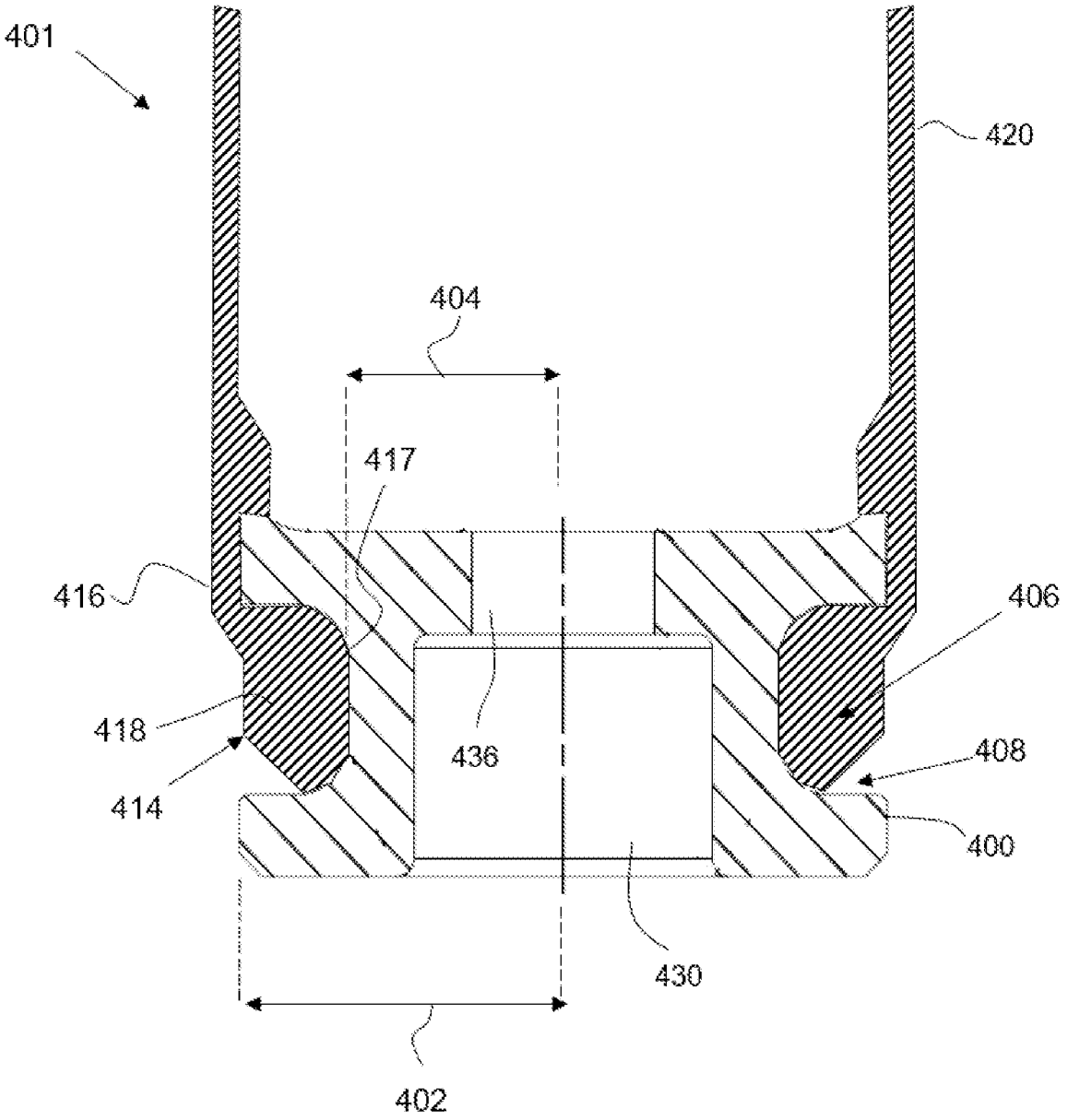
FIG. 4 shows an ammunition cartridge joined between an arrangement of the light weight end cap and a polymeric cartridge casing.

Turning to FIG. 4, there is provided a polymeric ammunition cartridge 401 comprising a polymer casing tube 420 connected to an end cap 400. In this example, the casing tube 420 comprises an outer skirt 416; wherein the outer skirt 416 is arranged to engage over the first radius 402 of the end cap 400, the outer skirt 416 further comprising a retaining portion 418; wherein the retaining portion 418 engages with the swept volume rebate 406 of the end cap 400 to form an insert 414. The inner radius 417 of the retaining portion 418 comprises a transition to a radius substantially equal to the second radius 404 of the end cap 400 in order to neatly form a snug fit into the swept volume rebate 406. In this arrangement, the casing tube 420 may effectively be joined to the end cap 400 by way of the outer skirt 416 wherein the retaining portion 418 acts as a male portion to engage with the swept volume rebate 406 acting as a female portion. Put another way, the skirt 416 and retaining portion 418 of the casing tube 420 may effectively act as an insert 414 as herein described in the first aspect. The polymer casing tube may be formed in-situ on the end cap 400.

In this arrangement, the ejector groove 408 is formed by a combination of the cartridge tube 420, specifically the retaining portion 418 and end cap 400 as defined in the first aspect.

Figure 5:
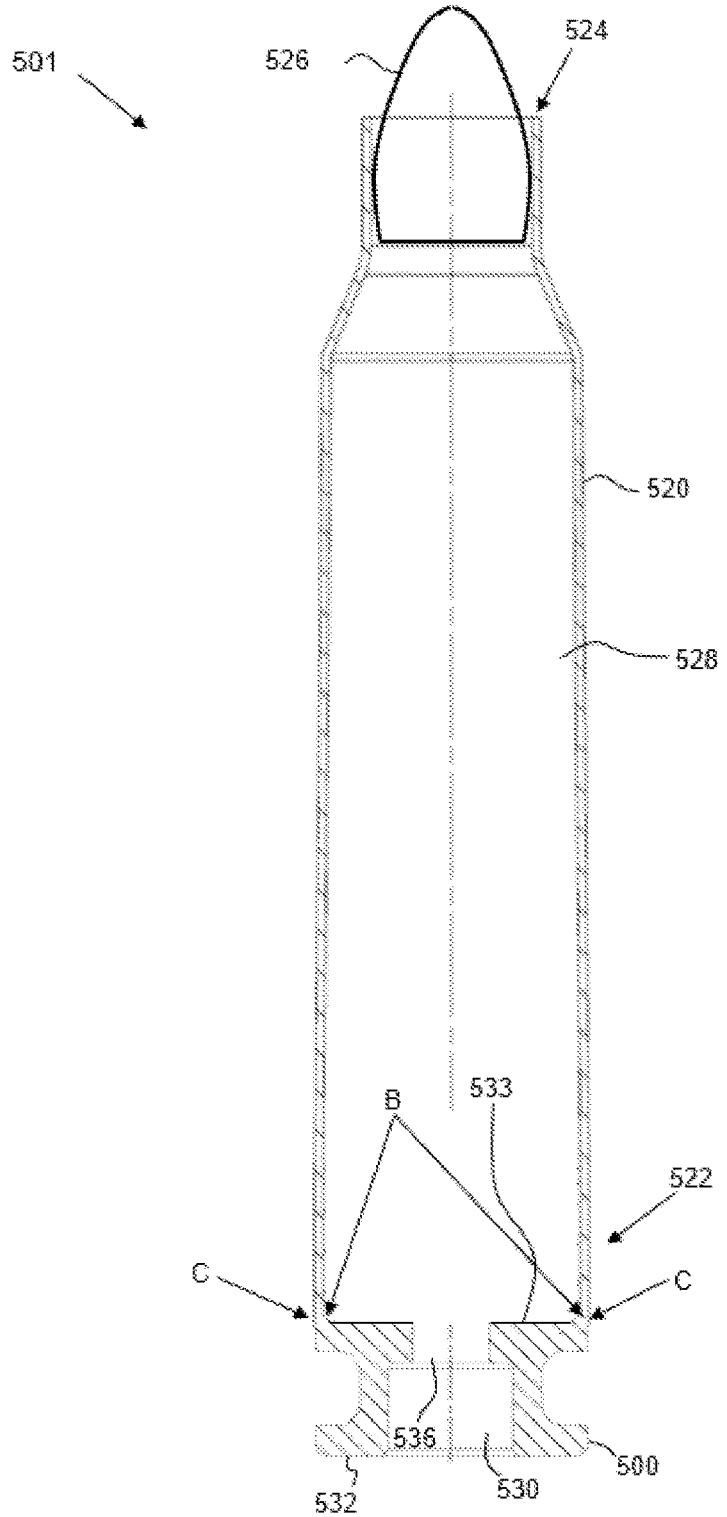
FIG. 5 shows an ammunition cartridge joined to the lightweight end cap by welding.

Turning to FIG. 5, there is provided an example cartridge casing 501 according to the present disclosure. The cartridge casing 501 comprises a casing tube 520 having a first end 522 which is closed by an end cap 500. The casing tube 520 is substantially cylindrical and has an internal diameter at the first end 522 which receives the end cap 500. The casing tube 520 bounds at least part of the end cap 500 entered into its first end 522. The end cap 500 is configured to support and reinforce the base of the casing tube 520 to prevent it from swelling and rupturing during operation. As will be described in more detail later, the end cap 500 is welded to the casing tube 520, thereby fixing the end cap 500 and casing tube 520 relative to one another.

In the context of the present disclosure, "welding" is intended to cover joining processes that produce bonding of materials by heating, which may be done with or without pressure or filler material. For example, the term is intended to encompass brazing and soldering. It may also be taken to encompass a process in which the material of one or more articles being joined are brought into a molten state to facilitate bonding. It may include a process in which the base materials melt along with a filler material.

The casing tube 520 further comprises a second end 524, which is open and configured to receive a projectile 526 opposite to the first end 522. The second end 524 has a diameter which may be substantially the same as, or less than, the diameter of the first end 522. In the example shown the diameter of the second end 524 is substantially less than the diameter of the first end 522.

The walls of the casing 520 define a substantially cylindrical thin walled chamber 528. The tube casing 520 has a substantially constant diameter along a first region of its length between the first end 522 and the second end 524. However, the cylindrical thin walled chamber 528 may have a taper (for example <1°) along at least part or all of its length.

The end cap 500 defines a passage 536 which extends all of the way through the end cap 500 which in use will be a flash tube (or "flash passage"). The flash tube/passage 536 extends into a chamber or cavity 530 which, in use, will house a percussion cap (sometimes referred to as a "primer"). Thus the end cap 500 has a percussion side 532 which, in use, faces away from the casing tube 520.

The end cap 500 further comprises a charge side 533 which, in use, defines part of the internal surface of the cartridge casing 520. Thus the flash passage 536 extends between the percussion side 532 and the charge side 533.

The end cap 500 has an external diameter at least part way along its outer periphery sized such that it fits within the first end 522 of the casing tube 520. The relative dimensions of the internal diameter at the first end 522 of the casing tube 520 and the external diameter of corresponding region of the end cap 500 may be such when the end cap 500 is located in the casing tube 520 they form an interference fit with one another.

The casing tube 520 and end cap 500 may comprise a welded join which bonds them together in a region where they form an interference fit with one another. For example, the join may be provided around the circumference of the casing tube 520 and end cap 500 in a region where they interface with one another. Such a region is indicated with arrows "C". The join may be a through weld or stake weld.

Alternatively the casing tube 520 and end cap 500 may comprise a join which bonds them together in the interior of the casing tube 520, for example in a region around a circumferential edge of an interface between the casing tube 520 and the end cap 500. Such a region is indicated with arrows "B".

The weld may achieved by laser welding. Alternative weld joins may be provided which brought only material of the casing tube 520 into a molten state, or brought material of both the casing tube 520 and end cap 500 into a molten state. The weld join may have been provided by any one of the welding processes as hereinbefore defined.

Figure 6A:
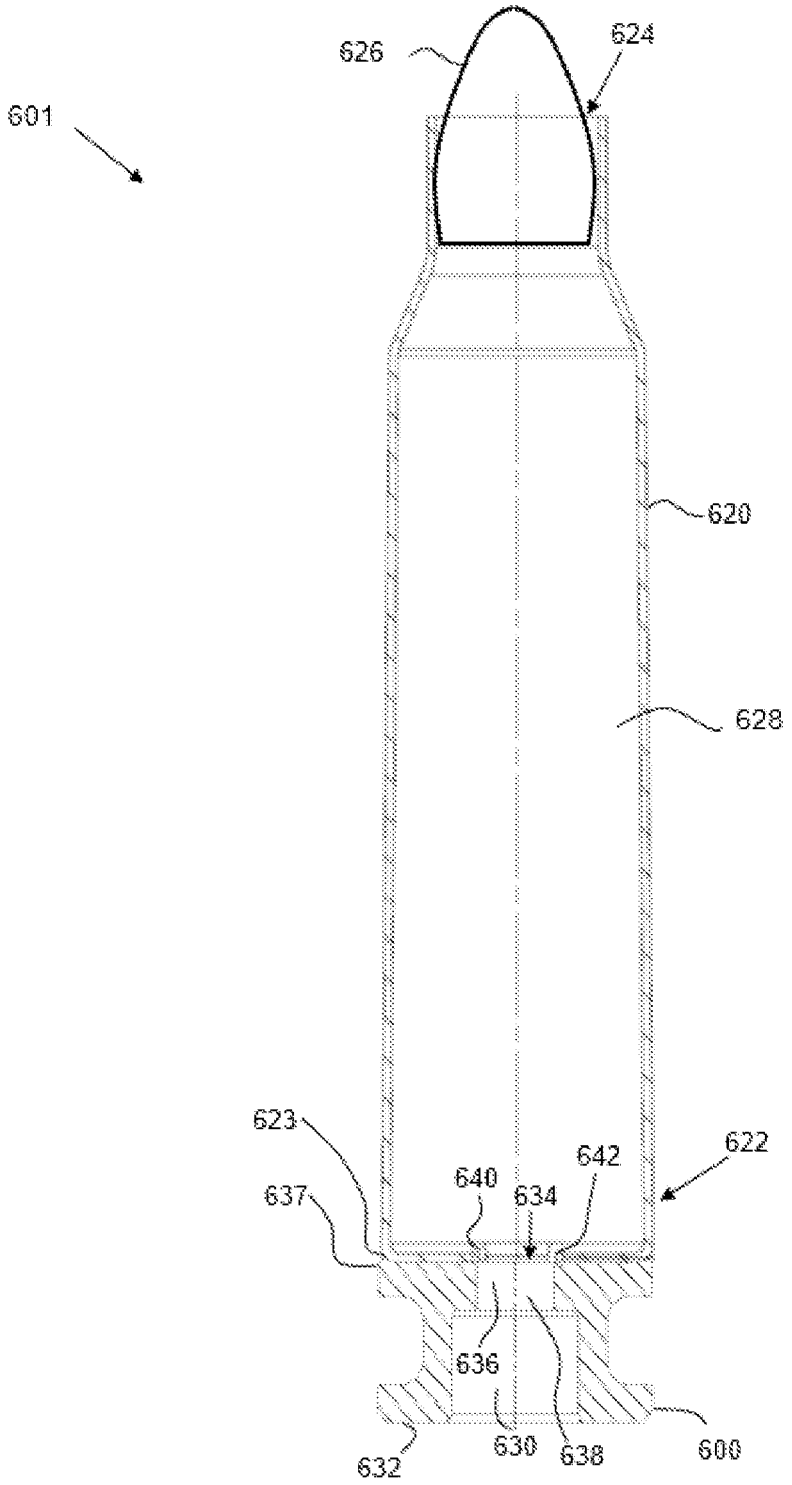
FIGS. 6*a* & 6*b* show an ammunition cartridge joined to the lightweight end cap by rivet joining.

Turning to FIG. 6*a* shows a cartridge casing 601 comprising a casing tube 620 having a first end 622 which forms a base of the casing tube 620. The walls of the casing tube 620 turn at a corner edge 623 to define the first end 622. The corner edge 623 may have a radius, or arcuate cross-section.

The casing tube 620 abuts at least part of the end cap 600 provided adjacent the first end 622. The end cap 600 is configured to support and reinforce the base of the casing tube 620 to prevent it from swelling and rupturing during operation. In part it achieves this by providing reinforcement to the end wall of the casing tube 620 which abuts the end cap 600.

Additionally, the end cap 600 is provided with a shoulder edge 637. The shoulder edge 637 may be formed integrally with the end cap 600. The shoulder edge 637 is provided towards the outer edge of end cap 600, and extends in a longitudinal direction away from the end cap 600. The shoulder edge 637 may have a radiused, or arcuate, cross-section. The corner edge 623 and shoulder edge 637 may be complementary in shape.

The corner edge 623 and shoulder edge 637 are sized and configured such that when the first end 622 of the casing tube 620 is seated on the end cap 600, the corner edge 623 of the casing tube 620 sits within the space, or region, defined by the shoulder edge 637 of the end cap 600. That is to say, the corner edge 623 and shoulder edge 637 are sized and configured such that when the first end 622 of the casing tube 620 is seated on the end cap 600, the shoulder edge 637 of the end cap 600 surrounds, encircles and/or bounds the corner edge 623 of the casing tube 620. Put another way, when the first end 622 of the casing tube 620 is fitted and located on the end cap 600, the shoulder edge 637 of the end cap 600 is substantially in contact with the whole of the circumference of corner edge 623 of the casing tube 620, and the shoulder edge 637 is configured to support loads induced in it by expansion of the casing. Thus, in operation, the shoulder edge 637 of the end cap 600 prevents the corner edge 623 of the casing tube 620 from moving radially outwards, for example beyond its original circumference or the circumference of the end cap 600.

The casing tube 620 further comprises a second end 624, which is open and configured to receive a projectile 626 opposite to the first end 622. The second end 624 has a diameter which may be substantially the same as, or less than, the diameter of the first end 622. In the example shown the diameter of the second end 624 is substantially less than the diameter of the first end 622.

The walls of the casing 620 define a substantially cylindrical thin walled chamber 628. The walls of the casing tube 620 are configured to contain a pressure in the chamber of up to about 500 MPa.

The end cap 600 defines a passage 636 which extends all of the way through the end cap 600 which in use will be a flash tube. The flash tube extends into a chamber or cavity 630 which, in use, houses a primer (not shown). Thus the end cap 600 has a percussion side 632 which, in use, faces away from the casing tube 620. The orifice 634 in the first end 622 of the casing tube 620 and head cap passage 636, when assembled in alignment, define a flash passage 638 which extends between the head cap percussion side 632 and the inside of the casing tube 620.

The end cap 600 and casing tube 620 are held together by a deformable member 632. The deformable member 640 extends from the passage 636 of the end cap 600 through the orifice 634 in the first end 622 of the casing tube 620 and aligns the passage 636 with the orifice 634.

In the example of FIG. 6*a* the deformable member 640 is provided as at least one deformable end, lip or region 642, which is deformable between a first shape (for example an undeformed configuration or state) in which the deformable member 640 may extend from the end cap 600 through the casing tube 620 during assembly, and a second shape (for example a deformed configuration or state) which fixes the casing tube 620 and the end cap 600 together. The deformable member 640 thus provides a mechanical joint between the end cap 600 and casing tube 620.

In the example of FIG. 6*a*, the deformable member 640 is integrally formed with the end cap 600. The deformable member 640 is deformable by swaging the region of the lip 642 which extends beyond the wall which defines the orifice 634 of the casing tube 620 such that the lip 642 becomes pressed against the wall of the casing tube 620 and draws the end cap 600 toward the base of the casing tube 620 to thereby clamp the casing tube 620 and end cap 600 together.

Figure 6B:
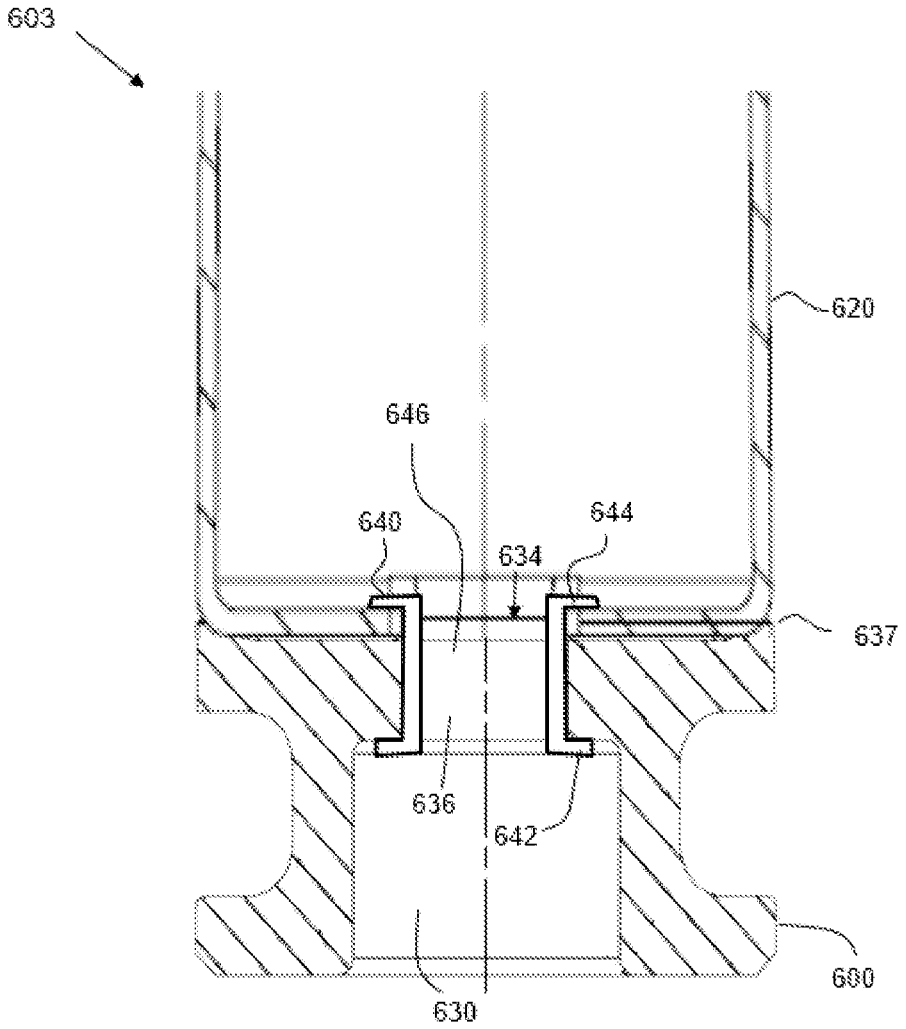

An alternative example of a cartridge casing 603 according to the present disclosure is shown in FIG. 6*b*. The example of FIG. 6*b* is similar in many ways to the cartridge case shown in, and as described with reference to, FIG. 6*a*. Features common to the examples of FIG. 6*a* and FIG. 6*b* are referred to using the same reference numerals.

In the FIG. 6*b* example the deformable member 640 is provided as a rivet like element which is provided separately to the end cap 600 and casing tube 620. The deformable member 640 is cylindrical, hollow and thin walled. The deformable member 640 (rivet) extends along the passage 636 in the end cap 600 and through the orifice 634 in the first end of the casing tube 620. The deformable member 640 is provided with at least one deformable end, or lip, 642 which is deformable between a first shape (for example an undeformed configuration or state) in which the deformable member 640 may extend between the casing tube 620 and the end cap 600 during assembly, and a second shape (for example a deformed configuration or state) which fixes the casing tube 620 and end cap 600 together. For example, the deformable end 642 of the deformable member 640 may be swaged to bring the end cap 600 and casing tube 620 into a fixed relationship relative to one another.

The deformable end 642 of the deformable member 640 may take the form of a region of material which is configured to extend beyond the orifice 634 and passage 636 into the percussion cap chamber 630, which may then be swaged to form a clamping flange. Alternatively the deformable end 640 may be configured to extend into the casing tube 620. In such examples the deformable member 640 may be provided with a shoulder 644 of greater diameter than the orifice 634 and passage 636, on the opposite end of the deformable member 640 to the deformable region 642, such that the deformable member 640 is trapped against one side of the orifice 634 and passage 636.

Alternatively, a deformable end 642 may be provided at both ends of the deformable member 640 such that both end regions of the deformable member 640, that is to say the region which extends into the percussion cap chamber 630 and the region the extends into the casing tube 620, may be deformed to clamp against the end cap 600 and the casing tube 620 respectively.

Put another way, the deformable member 640 is deformable by swaging either the region of a lip 642 which extends beyond the wall which defines the orifice 634 of the casing tube 620 and/or by swaging the region of a lip 642 which extends beyond the flash tube 646 into the percussion cap chamber 630. Swaging causes the lip 642 to become pressed against the wall of the casing tube 620 and/or end cap 600 to thereby draw the end cap 600 toward the base of the casing tube 620 to thereby clamp the casing tube 620 and end cap 600 together.

The casing tube 620 may be formed from a metal, metallic material or metal alloy comprising, for example, aluminium or a titanium. In one example the casing tube 620 may comprise ferritic alloys, for example stainless steel. The casing tube 620 may alternatively be formed from non-metallic material and/or metal-plastic composite material. The deformable member 640, i.e. the rivet, may be made of the same or a different material to the tube casing, for example stainless steel, titanium, brass or coated mild steel.

Although a few preferred arrangements have been shown and described, it will be appreciated by those skilled in the art that various changes and modifications might be made without departing from the scope of the invention, as defined in the appended claims.

The invention claimed is:

1. A unitary end cap for an ammunition cartridge, said end cap having a central axis along its axial length, the end cap comprising:
- a first radius relative to the central axis;
- a swept volume rebate having a second radius relative to the central axis and less than the first radius; and
- an extractor groove suitable for receiving an ejection mechanism;
- wherein the second radius is at least 30 to 60% smaller than the first radius, and
- wherein the swept volume rebate extends along in the range of 30-95% of the axial length of said end cap.

2. The end cap according to claim 1, wherein the end cap is made from a first material and the swept volume rebate is filled with an insert made from a second material, the second material having a density lower than the first material.

3. The end cap according to claim 1, wherein the second radius is in the range of from 30-45% smaller than the first radius.

4. The end cap according to claim 2, wherein the end cap comprises a rim, and said extractor groove is formed from a combination of the insert and the rim of the end cap.

5. The end cap according to claim 2, wherein the insert extends downwardly to form the rim and the extractor groove of the end cap.

6. The end cap according to claim 1, the swept volume rebate extends along at a length in the range of from 60 to 70% of the axial length of end cap.

7. The end cap according to claim 4, wherein the first radius is the radius of the rim.

8. The end cap according to claim 1, wherein the end cap is made from a material selected from brass, steel, or titanium.

9. The end cap according to claim 2, wherein the second material that forms the insert is a polymer, polymer composite, metal, metalloid, and alloys or composites thereof.

10. An ammunition cartridge comprising a cartridge and the end cap according to claim 1.

11. The ammunition cartridge according to claim 10, wherein material of the cartridge includes a polymer, a metal, a metal alloy, or a metalloid.

12. A method of manufacture of an end cap for an ammunition cartridge, said end cap having a central axis along its axial length, the end cap including
- a first radius relative to the central axis,
- a swept volume rebate having a second radius relative to the central axis and less than the first radius, and
- an extractor groove suitable for receiving an ejection mechanism,
- wherein the second radius is at least 30 to 60% smaller than the first radius, and wherein the swept volume rebate extends along in the range of 30-95% of the axial length of said end cap,
- the method comprising:
  - forming the end cap from a material;
  - removing material from the end cap to create the swept volume rebate in the end cap; and
  - providing the extractor groove.

13. The method according to claim 12, wherein the method comprises forming the end cap by an additive layer manufacturing technique.

14. The method according to claim 12, wherein the material is a first material, and the method comprises the additional step of filling the swept volume rebate with the insert made from a second material, the second material having a density lower than the first material.

15. The method according to claim 12, comprising: joining the end cap to a cartridge case by way of welding, riveting, or bonding.

16. A unitary end cap for an ammunition cartridge, the end cap having a central axis along its axial length, the end cap comprising:

a cylindrical component comprising a first radius relative to the central axis;

a recess that extends into the cylindrical component so as to provide the cylindrical component with a second radius relative to the central axis, wherein the second radius is at least 45% smaller than the first radius, and wherein the recess has an axial length that extends along 65% of the axial length of end cap;

an extractor groove suitable for receiving an ejection mechanism, the extractor groove formed at least in part by the recess; and a cavity located on a rearmost face of the end cap for receiving a primer.

17. The end cap according to claim 16, comprising:

an insert within the recess and having an inner radius substantially equal to the second radius and an axial length substantially equal to the axial length of the recess;

wherein the cylindrical component is made from a first material and the insert is made from a second, lower density material, in the form of a polymer;

wherein the ejector groove is provided by a combination of the insert and the recess.

18. An ammunition cartridge comprising:

the end cap according to claim 16;

a cartridge casing having a chamber; and wherein the end cap includes a through hole linking the cavity to the chamber of the cartridge casing.

19. The ammunition cartridge of claim 18, wherein the cartridge casing is a polymeric cartridge casing and comprises an outer skirt arranged to engage over the first radius, the outer skirt including a retaining portion that engages with the recess of the end cap to form an insert, wherein an inner radius of the retaining portion comprises a transition to a radius substantially equal to the second radius to form a snug fit into the recess, and wherein the ejector groove is provided by a combination of the retaining portion and the recess.

20. The ammunition cartridge of claim 18, wherein the cartridge casing includes a casing tube having a first end coupled to the end cap and a second end configured to receive a projectile.

* * * * *